United States Patent [19]

Clark

[11] 4,142,267

[45] Mar. 6, 1979

[54] BRUSH FRAME AND SHELL

[76] Inventor: Gaylord J. Clark, P.O. Box 71C, Coloma, Mich. 49038

[21] Appl. No.: 650,533

[22] Filed: Jan. 19, 1976

Related U.S. Application Data

[62] Division of Ser. No. 440,284, Feb. 7, 1974, Pat. No. 3,942,210.

[51] Int. Cl.[2] ..... A46B 7/10; A46B 13/04

[52] U.S. Cl. ..... 15/179; 15/53 A; 15/50 C; 15/183

[58] Field of Search ..... 15/179–183, 15/198, 200, 53 A, 53 AB, 50 C, DIG. 2, 21 E, 21 D

[56] References Cited

U.S. PATENT DOCUMENTS

| | | | |
|---|---|---|---|
| 1,529,691 | 3/1925 | Davis | 15/21 D X |
| 3,237,233 | 3/1966 | Adams | 15/182 |
| 3,349,423 | 10/1967 | Lousberg | 15/183 |
| 3,543,319 | 12/1970 | Posner | 15/53 A |
| 3,613,140 | 10/1971 | Oas | 15/179 X |
| 3,761,986 | 10/1973 | Rickel | 15/183 X |

OTHER PUBLICATIONS

Auto Laundry News, FMC Corporation, published May, 1973, p. 13.

*Primary Examiner*—Peter Feldman
*Attorney, Agent, or Firm*—Blanchard, Flynn, Thiel, Boutell & Tanis

[57] ABSTRACT

A rotary brush construction comprised of a drumlike frame having a plurality of replaceable, semi-cylindrical, bristle-carrying sections removably attached thereto. The brush sections are mounted in opposed pairs on the frame. The means attaching the brush sections to the frame can be easily removed and replaced.

12 Claims, 15 Drawing Figures

BRUSH FRAME AND SHELL

This is a division of application Ser. No. 440 284, filed Feb. 7, 1974, now U.S. Pat. No. 3,942,210.

FIELD OF THE INVENTION

This invention relates to a rotary brush construction and, more particularly, to a type thereof having replaceable bristle-carrying shells designed for use in a car-washing operation.

BACKGROUND OF THE INVENTION

The sizes and shapes of automobiles and the types and locations of parts projecting therefrom, such as bumpers and the like, are constantly changing so that rotary brushes used in automatic equipment for washing vehicles are frequently and seriously damaged under circumstances which cannot be adequately anticipated. Thus, it is of great importance to provide a brush construction which can be quickly and easily, hence inexpensively, repaired to minimize loss of money and time, thereby increasing the efficiency in, and profit from, the car washing operation.

It is equally important that the rotary brushes be capable of quick and easy removal and replacement where such is necessitated by the wear and tear of the brush bristles resulting from ordinary use. Further, due to the size and shape of automobiles, and the various parts which project therefrom, selected areas of the brushes are subject to a more rapid rate of wear than are other brush areas. These selected areas, when worn, prevent adequate washing of the vehicle and thus it is often necessary to replace the complete brush assembly or, in the alternative, substantially disassemble and reassemble the complete brush assembly in order to replace a worn section.

Further, with the advent of rubber or other shock absorbing bumpers on the vehicles, it has been discovered that those areas on the brushes which contact the bumpers not only tend to have greatly increased wear, but also have a tendency to "hang-up" or become locked to the car bumper. This can result in damage to the vehicle, brush or both.

The increased wear caused by vehicle projections, such as bumpers, obviously requires substantially increased maintenance and replacement of the brushes. Likewise, the potential damage which worn brushes can cause to the vehicles has increased the maintenance required and has thus decreased the profit of such car-washing operations.

Many attempts have been made to produce brushes which would successfully overcome the above-mentioned disadvantages, and one such brush construction is disclosed in my prior U.S. Pat. No. 3 439 373. However, in a continuing effort to improve upon, and reduce the cost of, the procedure of replacing worn or damaged brushes or brush bristles, while at the same time increase brush wear, I found that much time could be saved by constructing the brush from a plurality of removable arcuate brush sectors which could also have the bristle density thereof varied as desired to result in optimum washing and wear characteristics relative to the configuration of the vehicles.

Accordingly, a primary object of this invention is the provision of an improved rotary brush structure which provides a rotary drumlike hub or frame having a plurality of removable arcuate brush sections mounted thereon. The brush sections preferably comprise semicylindrical shells which are mounted in opposed pairs on the hub. Several pairs may be disposed axially adjacent one another along the length of the hub. This brush structure thus enables individual worn sections to be easily removed and replaced without requiring disassembly of the entire brush construction. At the same time, this structure permits various brush sections to be axially interchanged or their orientation reversed to provide for more uniform wear on all of the brush sections.

A further object of the present invention is to provide an improved brush construction, as aforesaid, which enables the arcuate brush sections to be attached to or removed from the hub in a simple manner while at the same time the arcuate brush sections can be individually economically constructed.

Still a further object of the present invention is to provide an improved brush construction, as aforesaid, which is extremely durable but of rather light weight so as to facilitate the mounting and driving thereof to thus minimize wear on the bearings and other associated driving parts.

Another object of the present invention is to provide an improved brushing construction, as aforesaid, wherein some of the arcuate brush sections have a variable bristle density, such as by having a plurality of short bristles uniformly intermixed with a plurality of long bristles, so that the outer portion of the brush section is of lower density than the inner portions to result in improved cleaning and washing of the vehicle along specific areas thereof, such as along the ridges of the side panels and around the bumpers, while at the same time greatly minimizing brush wear.

It is also an object of the present invention to provide a brush construction, as aforesaid, which includes means for effectively lubricating the high wear areas of the brush, such as those areas of the brush which contact the bumpers and the like, by injecting substantial quantities of lubricant, such as soapy water, into the brush bristles at this area to thus minimize drag of the bristles along the vehicle while at the same time improving the washing characteristics of the brush construction.

Other objects and purposes of the invention will be apparent to persons familiar with rotary brush constructions upon reading the following description and examining the accompanying drawings.

For convenience in the following description, the terms "inner", "outer" and words of similar import will have reference to the central axis of the rotary brush construction and designated parts thereof.

SUMMARY OF THE INVENTION

The objects and purposes of the invention, including those set forth above, have been met by providing a rotary hub structure having a plurality of bristle-carrying brush sections removably attached thereto. The brush sections preferably comprise substantially semi-cylindrical shells which are disposed in opposed pairs on the hub. The individual brush sections are secured to the hub by removable means, such as by a single threaded fastening member extending through the center of each brush section and fixedly anchored to the hub. The hub, in a preferred embodiment, is formed from a plurality of axially spaced disklike support members which are secured to a central shaft, which support members are fixedly connected by angularly spaced, axially extending mounting bars to which the brush sections are fixedly connected. The arcuate segments may initially be formed with a diameter slightly smaller than that of the hub so as to be elastically deformed when mounted on the hub, whereupon the arcuate segments can be fixedly connected to the hub by a single threaded fastening element. Further, if desired, one or more of the opposed pairs of arcuate sections may be provided with a different diameter or a different bristle density to facilitate engagement of said sections with projecting portions of the vehicle. This area may also be provided with a greater quantity of lubricant, such as soapy water, supplied thereto for minimizing brush wear and increasing washing efficiency.

DETAILED DESCRIPTION

Figure 1:
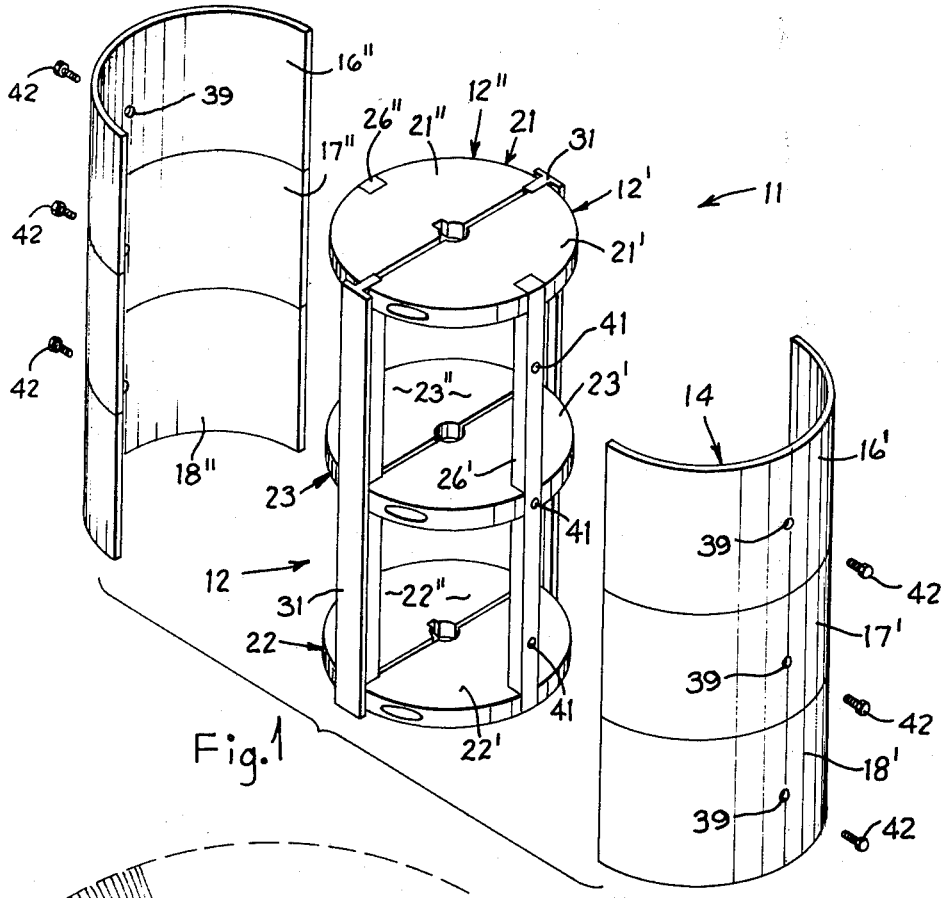
FIG. 1 is an exploded, perspective view of a rotary brush construction according to the present invention, the arcuate brush segments depicted in FIG. 1 being illustrated with the bristles removed therefrom for clarity of illustration.
Figure 3:
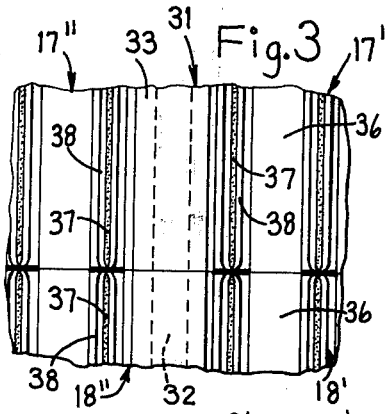
FIG. 3 is a fragmentary view taken substantially along the line III—III in FIG. 2.
Figure 2:
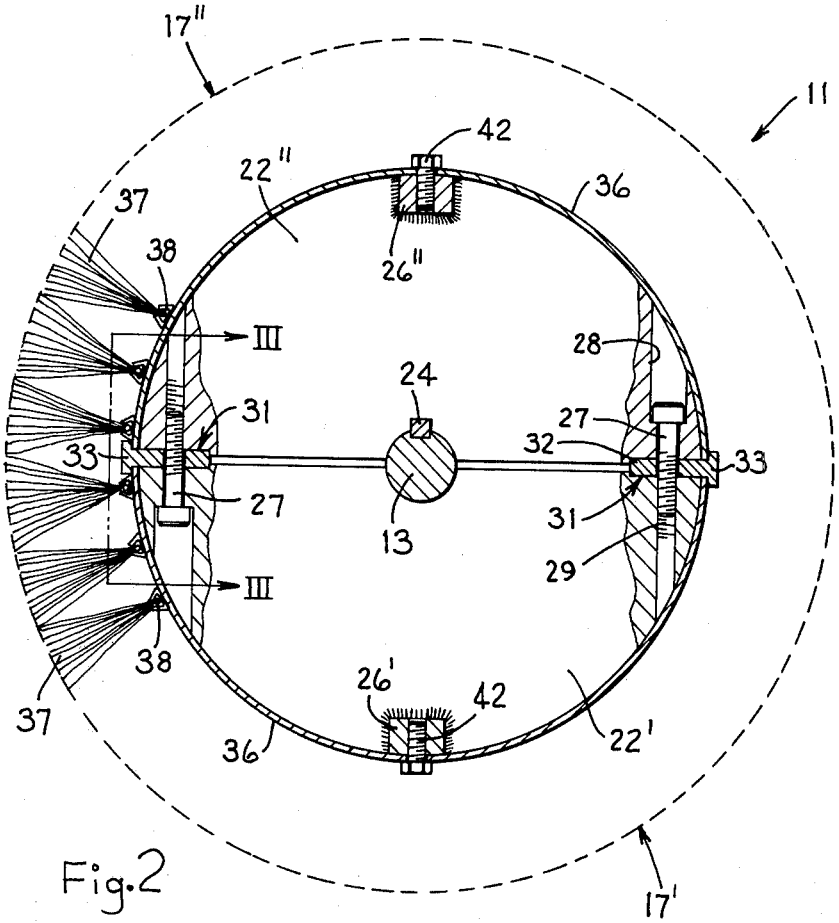
FIG. 2 is a fragmentary cross-sectional view of a brush construction according to the present invention and including therein the hub structure illustrated in FIG. 1.

Referring to the drawings, FIGS. 1–3 illustrate therein one embodiment of the present invention wherein the brush construction 11 includes a drumlike hub assembly 12 adapted to be nonrotatably secured on a supporting shaft 13. A plurality of substantially identical bristle-carrying brush sections 14 are adapted to be removably secured to the drum assembly 12. The brush sections 14 have been illustrated in FIG. 1 with the bristles removed for purposes of illustration only. Further, the brush sections 14 are disposed in opposed pairs when mounted on the hub assembly, and a plurality of said opposed pairs are mounted axially along the hub assembly. For purposes of subsequent identification, the opposed pairs of brush sections have been identified as 16'—16'', 17'—17'' and 18'—18'' in FIG. 1.

Considering now the hub assembly 12, same includes (for purposes of illustration only) a pair of end collars 21 and 22 and an intermediate collar 23 disposed substantially midway therebetween. The end collar 21 is constructed from a pair of separable, substantially semi-cylindrical, platelike segments 21' and 21'' which, when assembled around the shaft 13, comprise an annular disklike support. The other end collar 22 is similarly constructed and includes a pair of semi-cylindrical segments 22' and 22'', and the intermediate collar 23 similarly includes a pair of opposed semi-cylindrical segments 23' and 23''. The end collars 21 and 22 are suitably nonrotatably connected to the shaft 13, as by a conventional key 24, for enabling the hub assembly 12 to be nonrotatably connected to the shaft 13.

The collar segments 21', 22' and 23' are fixedly connected in axially spaced relationship to one another by an elongated connecting bar 26' extending therebetween. The connecting bar 26' is fixedly connected to these collar segments, such as by welding, to maintain the segments in substantially parallel relationship. The connecting bar 26', as illustrated in FIG. 1, is disposed substantially at the midpoint of the external arcuate periphery of the segments and, when the segments are mounted on the shaft 13, extends substantially parallel to the rotational axis of the shaft.

The opposite collar segments 21'', 22'' and 23'' are similarly fixedly connected by a further elongated bar 26'' which extends between and is fixedly connected to the respective collar segments. The connecting bar 26' and its associated collar segments thus results in one relatively rigid hub subassembly, and the connecting bar 26'' and its associated segments results in a second substantially rigid hub subassembly, which two subassemblies can then be mounted on or removed from the shaft 13 by movement in a radial direction relative to the shaft. The use of these hub subassemblies not only facilitates the mounting or removing of the hub assembly from the shaft, but also greatly simplifies storing and shipping of the hub structure. Further, when the two hub subassemblies are mounted on the shaft, the connecting bars 26' and 26'' are disposed on substantially diametrically opposite sides of the shaft 13, as illustrated in FIGS. 1 and 2.

The hub subassemblies 12' and 12'' are here illustrated as fixedly connected to the shaft 13 by pairs of threaded fastening members, specifically screws 27, which screws fixedly connect the coacting pairs of collar segments. As illustrated in FIG. 2, each collar segment has a bore 28 formed in one end thereof and a threaded bore 29 formed in the other end thereof whereby when the segments are disposed directly opposite one another, the bores 28 and 29 are aligned. The screws 27 are received within the bores 28 and threadably engage the bores 29 for fixedly connecting the collar segments together.

The hub assembly 12 further includes a pair of elongated and substantially opposed bars 31 which, in the illustrated embodiment of FIG. 1, are of a T-shaped cross-section and extend axially throughout the length of the hub, being disposed substantially parallel to and on diametrically opposite sides of the shaft 13. The T-bars, which are spaced at an angle of approximately 90° from the connecting bars 26' and 26'', are disposed at the interface of the opposed collar segments and are suitably clamped therebetween. For this purpose each T-bar 31 includes a center web portion 32 which projects inwardly between the opposed pairs of collar segments, such as between the segments 22' and 22'' illustrated in FIG. 2. The web portion 32 also includes a suitable opening therein associated with each collar for enabling the connecting screw 27 to extend therethrough, whereby the screws 27 thus cause the opposed pairs of segments to be moved toward one another into clamping engagement with the web portion 32. Each T-bar 31 also includes a head or flange portion 33 provided on the radially outer end of the web portion 32, which head portion 33 projects substantially perpendicular to the web portion 32 and is spaced radially outwardly a predetermined distance from the outer periphery of the collar segment for a purpose to be explained hereinafter.

Considering now the brush segments 14, and referring specifically to FIG. 2 wherein the brush segments 17' and 17'' are illustrated, only the brush section 17' will be described in detail since all of the brush sections are substantially identical.

The brush section 17' includes an arcuate support plate 36, which support plate can be constructed from a substantially rectangular piece of steel plate and then rolled into the desired arcuate configuration. The support plate 36, in this illustrated embodiment, has the inside surface thereof generated about a radius which is substantially equal to the outer radius of the collars 21, 22 aand 23 when mounted on the shaft 13. Further, the support plate 36 in the illustrated embodiment extends through an angle of approximately 180° and is thus substantially semi-cylindrical. The support plate 36 has a plurality of conventional bristles 37 mounted thereon and projecting radially outward thereof, which bristles are mounted on the plate 36 in any conventional manner. In the illustrated embodiment, the bristles 37 are fixedly clamped within elongated channel-shaped members 38 which are fixedly secured, as by spot welding, to the outer surface of the support plate 36. As illustrated in FIG. 3, the plate 36 is provided with a plurality of substantially parallel channel-shaped members 38 fixedly secured thereto and extending axially thereof, which members 38 are spaced from one another. Each member 38 has a plurality of bristles 37 mounted therein. The construction of the channel members 38 carrying the bristles 37 therein, and the manner in which they are attached to the support plates 36, is explained in detail in my prior U.S. Pat. No. 3 439 373.

For mounting the brush sections 14 on the hub assembly 12, each support plate 36 is provided with a center opening 39 therein. Further, each connecting bar 26' and 26'' is provided with a plurality of axially spaced threaded bores 41 therein which are adapted to align with the openings 39. A conventional threaded fastener 42, such as a screw, extends through each opening 39 and threadably engages the bore 41 for fixedly connecting each of the brush sections 14 to the hub assembly 12. The support plates 36 associated with each brush section 14 have a width which is substantially equal to the spacing between the threaded bores 41 so that the axially adjacent brush sections, such as the section 16', 17' and 18', when mounted on the hub assembly 12 are disposed with their adjacent axial edges closely adjacent one another.

Further, when the brush sections 14 are mounted on the hub assembly 12, the opposite free ends of each support plate 36 are slidably but snugly disposed beneath the laterally projecting flange portions 33, which flange portions 33 thus retain the free edges of the individual brush sections directly adjacent the periphery of the collar segments. The flange portions 33 thus prevent the free ends of the brush segments from being deflected outwardly away from the hub assembly, either due to centrifugal force or due to the brush bristles being caught or hung up on the vehicle.

Figure 4:
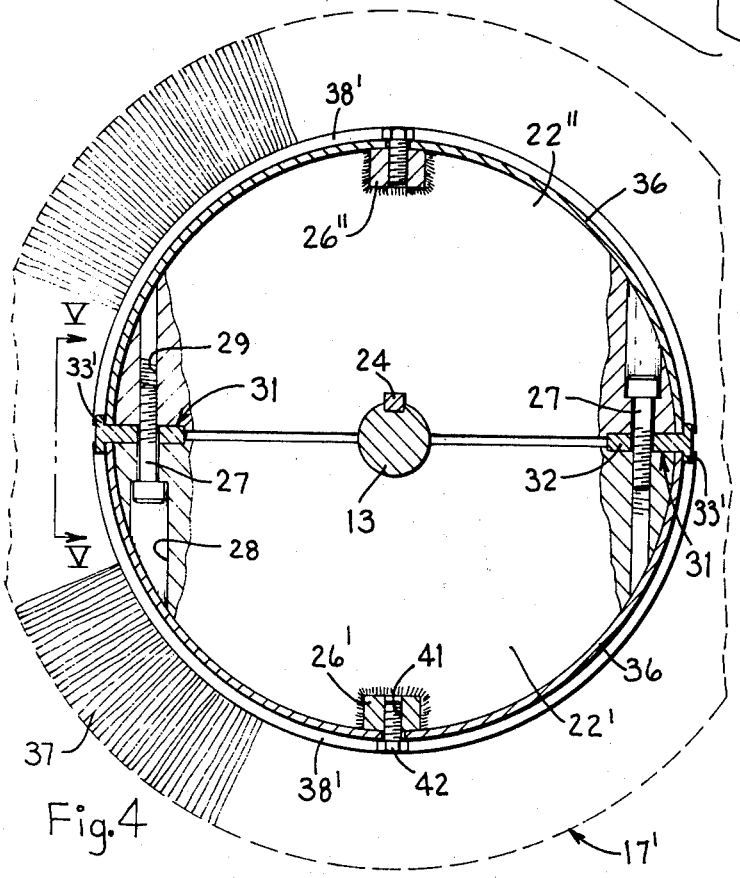
FIG. 4 is a cross-sectional view of a brush construction similar to that illustrated in FIG. 2 but wherein the brush segments are mounted within channels which extend spirally of the hub.
Figure 5:
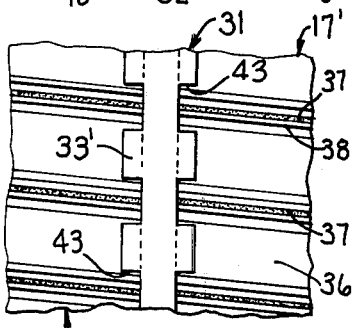
FIG. 5 is a fragmentary view taken substantially along the line V—V in FIG. 4.
Figure 10:
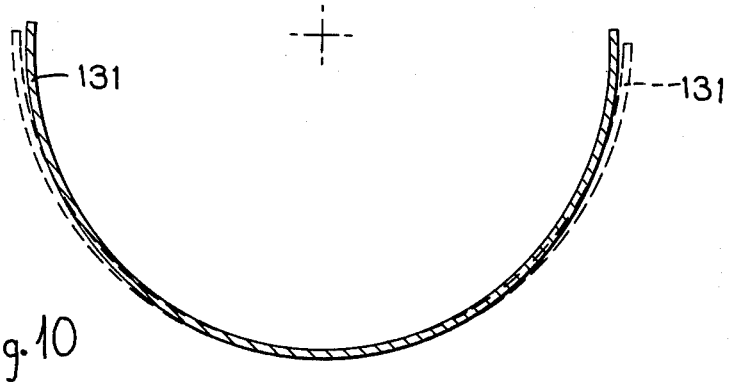
FIG. 10 is a sectional view of the shell used in the brush construction of FIGS. 6–9.

FIGS. 4 and 5 respectively correspond to FIGS. 2 and 3 but illustrate therein a brush construction which is a slight modification of the brush construction illustrated in FIGS. 2 and 3. In this embodiment, the channel-shaped members 38' extend circumferentially of the plate 36 so as to likewise extend circumferentially of the hub assembly 12 when the bristle-carrying sections are mounted thereon. The channel-shaped members 38' may extend either circumferentially of the plate 36 as to be disposed within a plane which is substantially perpendicular to the axis of the shaft 13, or the members 38' may extend at an angle relative to this plane (as illustrated in FIG. 5) to thus spiral around the hub assembly.

As illustrated in FIG. 5, the flange portion 33' of each T-bar 31 may be provided with opposed pairs of clearance notches 43 formed therein and spaced substantially uniformly therealong. The notches 43, which notches are spaced consistent with the spacing between the channel members 38', thus enables the bristle-carrying members 38 to extend to the free edge of the respective support plates 36 to thus minimize the circumferential gap or discontinuity which is created between the aligned bristle-carrying members 38 as formed on the adjacent pair of brush segments. Except for the above-mentioned structural variations, the brush construction of FIGS. 4 and 5 is in all other respects identical to the brush construction illustrated in FIGS. 1–3.

Figure 6:
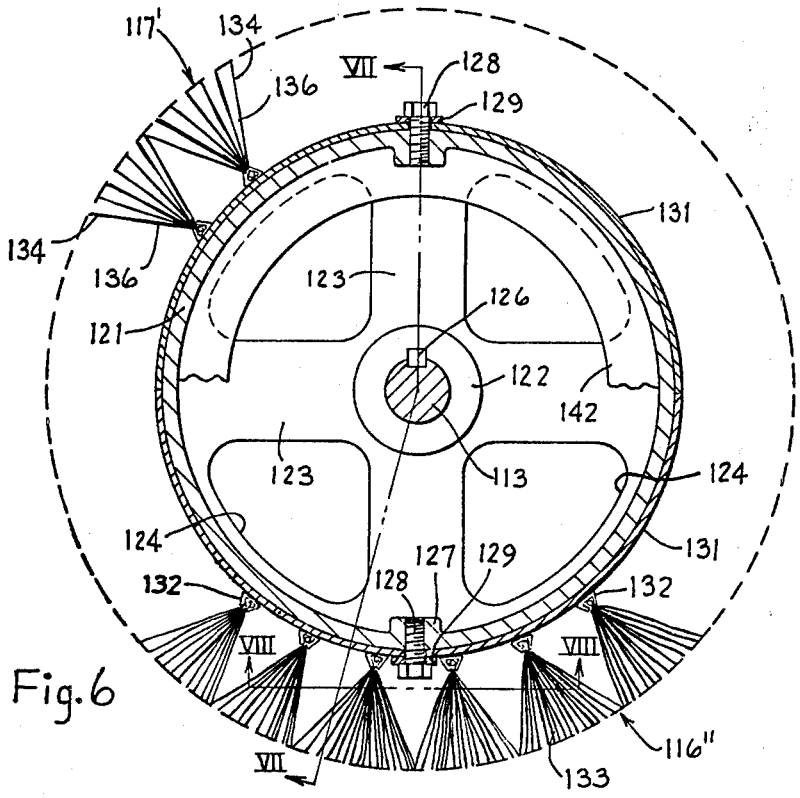
FIG. 6 is a cross-sectional view of a modified brush construction according to the present invention, as taken substantially along the line VI—VI in FIG. 7.
Figure 7:
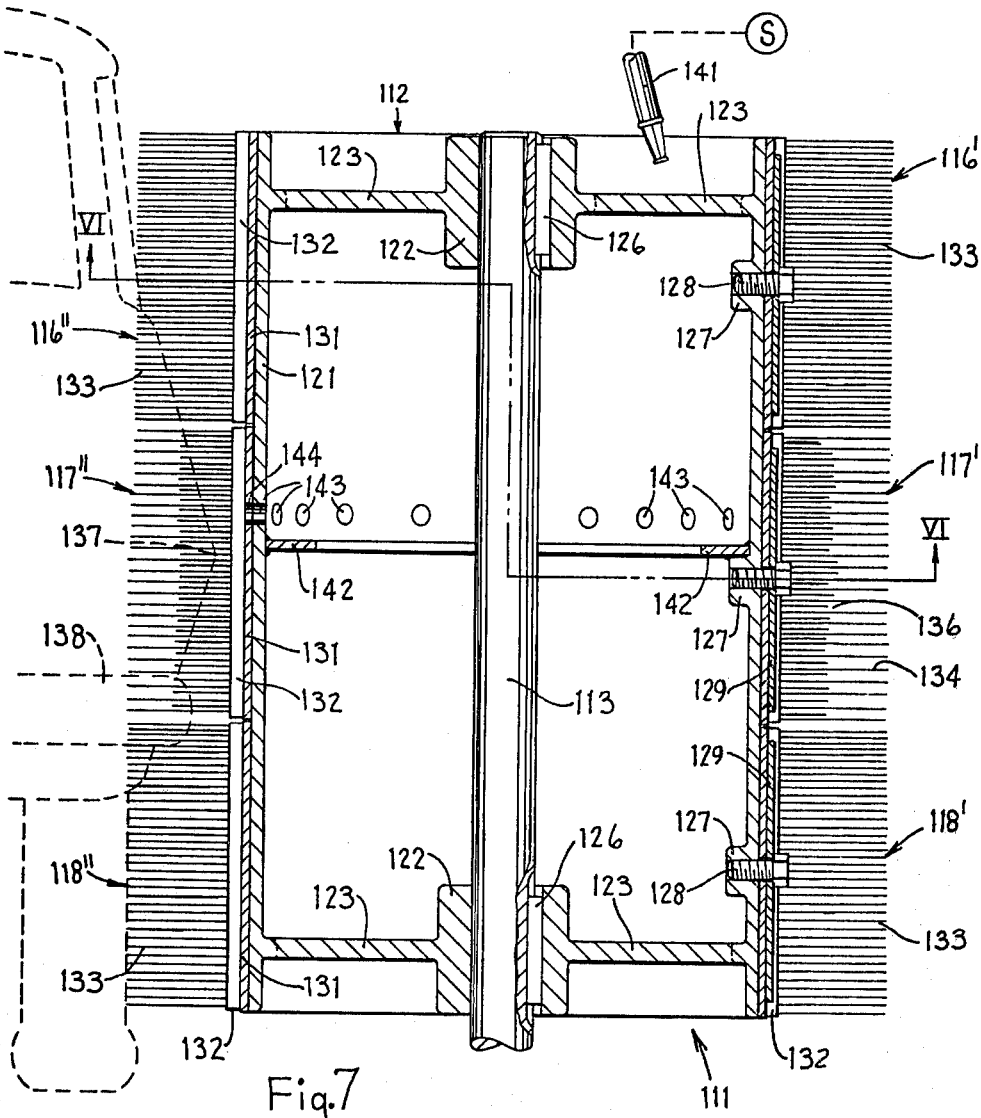
FIG. 7 is a central-sectional view as taken substantially along the line VII—VII in FIG. 6.

FIGS. 6–10 illustrate therein a modified brush construction 111 which is similar to the brush construction 11 described above in that it again consists of a brush having a plurality of opposed pairs of readily replaceable brush sections. More specifically, the brush construction 111, as illustrated in FIGS. 6 and 7, comprises a rotatable hub assembly 112 which is nonrotatably secured to a shaft 113 and has a plurality of replaceable brush segments or sections mounted thereon. In the illustrated embodiment, the brush construction 111 has opposed pairs of brush sections 116'–116'', 117'–117'' and 118'–118'' removably mounted thereon.

The hub assembly 112, in this embodiment, consists of a unitary, one-piece, drumlike member having an elongated outer tubular shell 121 and a pair of support hubs 122 disposed adjacent the opposite axial ends thereof. The hubs 122 are fixedly, here integrally, connected to the outer shell 121 by a plurality of radially extending spokes 123, which spokes define openings 124 therebetween. The hubs 122 are nonrotatably connected to the shaft 113 in a conventional manner, as by keys 126. The shell 121 is further provided with a plurality of bosses or enlargements 127 on the inner wall thereof for permitting the formation of threaded bores therein, which bores enable each brush section to be removably attached to the external periphery of the shell 121 by means of a single threaded fastener or screw 128. If desired, an elongated bearing member 129 can be positioned under the head of the screw 128 for minimizing the stress concentration due to the clamping engagement created by the screw member.

With respect to the segmental brush sections, they are constructed substantially similar to the brush sections described above, particularly as illustrated in FIGS. 1–3. More specifically, and referring to the brush section 116″ illustrated in FIGS. 6–8, same includes an arcuate suport plate 131 which extends through an angle of substantially 180°. The support plate 131 has a plurality of channel-shaped elements 132 fixedly secured to the external surface, which channel elements 132 are parallel to one another and extend axially of the support plate 131 and clampingly support therein a plurality of bristles 133. The support plate 131 also has a central opening therethrough which aligns with the threaded opening formed in the boss 127 for enabling the brush section to be connected to the hub 112 by means of the threaded fastener 128. The brush section 116″, as so far described, is thus substantially identical to the brush sections as described above relative to FIGS. 1–3.

However, the brush section 116″ does possess one structural feature which is different from the brush sections described above, and that feature is illustrated in FIG. 10. The support plate 131, in this embodiment, is initially provided with an inner curvature which is defined by a radius which is slightly smaller than the external radius of the hub shell 121. Thus, when the support plate 131 is in an unstressed or relaxed condition, as illustrated by solid lines in FIG. 10, the free ends of the support plate 131 are spaced apart by a diametrical distance which is slightly smaller than the diameter of the shell 121. Thus, when the brush section is mounted on the shell 121, the support plate 131 must be slightly elastically deformed, as by elastically deflecting the free ends of the support plate 131 outwardly substantially as illustrated by dotted lines in FIG. 10, whereupon the inner surface of the support plate 131 thus assumes a configuration substantially identical to the external cylindrical configuration of the shell 121. This construction is highly desirable since each individual brush section can be mounted on the shell 121 solely by the use of a single fastening screw 128. Accordingly, the free edges of the support plates are pretensioned into engagement with the shell and are not easily moved away therefrom.

Further, the necessity of resiliently deflecting the free edges of the support plate 131 outwardly away from one another does not greatly increase the difficulty of mounting the brush sections on the shell 121, since the free edges will readily resiliently deform as the support plate 131 is pushed radially inwardly into snug engagement with the periphery of the shell 121. Further, this elastic deformation of the plate 131 when mounted on the shell 121 also facilitates removing of the brush sections since, upon loosening of the screw 128, the support plate 131 naturally disengages the drum. In this manner, seizing of the support plates 131 on the drum 121 is effectively prevented.

While only the brush section 116″ has been described in detail above, it should be noted that all of the remaining brush sections can be constructed in an identical manner. In fact, the brush sections 116′,118′ and 118″ are all identical to and interchangeable with the brush section 116″.

FIG. 7 illustrates therein a further variation of the present invention wherein the center brush sections, namely the sections 117′ and 117″, are provided with a variable bristle density for minimizing brush wear. The sections 117′ and 117″ are in all other respects identical to the section 116′ as described above.

As illustrated in FIG. 7, the sections 117′ and 117″ again include a plurality of bristles 134 which are mounted within elongated channel members 132 secured to and extending axially of the arcuate support plate 131. The bristles 134 are substantially identical to the bristles 133, that is, they are of substantially the same length. However, the density of the bristles 134 is substantially less than the density of the bristles 133. For example, the bristles 134 are substantially half as dense as the bristles 133. Each of the channel-shaped members 132 associated with the sections 117′ and 117″ have still further bristles 136 held therein and intermixed with the bristles 134. The bristles 136 have a length substantially less than the bristles 134, and in the illustrated embodiment the bristles 136 are approximately one-half the length of the bristles 134. However, the combined density of the bristles 134 and 136 is approximately the same as the density of the bristles 133 so that the brush sections 117′ and 117″ have an inner bristle density which is substantially the same as the density of the bristles 133 associated with the upper and lower brush sections. However, the sections 117′ and 117″ have an outer bristle density which is defined solely by the bristles 134, and thus this density is approximately one-half the density of the bristles 133 as contained on the other brush sections.

Providing the center brush sections 117′ and 117″ with a variable density bristle construction, as illustrated in FIG. 7, is highly desirable since these center brush sections normally engage those portions of the vehicle which project laterally outwardly the greatest extent, which vehicle portions result in maximum brush wear when all of the brush sections are provided with a uniform bristle density. As diagramatically illustrated on the left side of FIG. 3, the side panels of most vehicles contain an outwardly projecting ridge 137 extending longitudinally therealong, which ridge is normally disposed so that it is engaged by the centermost sections of the rotating brush. Similarly, the bumpers of a vehicle also project laterally outwardly a greater distance from the vehicle than the adjacent sections thereof and the bumpers likewise often engage the centermost sections of the brush.

Thus, when utilizing a brush as illustrated in FIG. 7, the outwardly projecting ridge portion 137 and the bumpers 138 are both engaged by the center brush sections 117′ and 117″. These projecting portions 137 and 138 thus project further into the bristle structure and are thus disposed more closely adjacent the shell 121 than are the other portions of the vehicle. Since the use of a uniform bristle density would normally result in substantially increased pressure in this area due to the greater compression of the bristles, this likewise results in substantially increased wear of the bristles associated with the center portions of the brush construction. However, by providing the center portion 117′ and 117″ with a variable bristle density, as described above, the ridge portion 137 and the bumper 138 can project inwardly into the bristles by a greater extent without resulting in any substantial increase in the compression of the bristles due to the lower density of the bristles, particularly adjacent the periphery of the rotating brush. At the same time, the greater projection resulting from the ridge portion 137 and the bumper 138 still results in same coming into engagement with the more dense bristle construction which is provided by the shorter bristles 136. Accordingly, these outwardly projecting portions of the vehicle are still adequately washed while at the same time the wear of the bristles, particularly on the center brush sections 117' and 117'', is substantially minimized. These center brush sections will thus wear in a manner which is more consistent with the normal wear encountered on the upper and lower brush sections.

The brush construction illustrated in FIG. 7 possesses still a further modification which facilitates the washing of the vehicle and at the same time minimizes both brush wear and brush and/or vehicle damage. More specifically, the brush construction 111 of FIG. 7 may be provided with a flow nozzle 141 disposed adjacent the upper end thereof, which flow nozzle is connected to the suitable source S of a fluid lubricant, such as soapy water. The nozzle 141 causes the lubricant to be injected through the openings 124 as provided between the spokes 123 so that the fluid impinges on the inner wall of the rotating shell 121. The rotation of the shell 121 creates sufficient centrifugal force to maintain the liquid lubricant on the inner wall thereof, and gravity causes the liquid lubricant to flow downwardly along the inner wall until it comes into contact with an annular ringlike baffle 142 which is fixedly secured to the inner wall of the shell 121 and projects radially inwardly thereof. The baffle 142 is disposed substantially adjacent the midpoint of the shell 121, and is thus substantially adjacent the axial midpoint of the center brush sections 117' and 117''. The shell 121 has a plurality of circumferentially spaced openings 143 extending radially therethrough directly above the baffle 142. The openings 143 are substantially aligned with a plurality of further circumferentially spaced openings 144 as formed in the support plates 131 associated with the center brush sections 117' and 117''.

Accordingly, as the liquid lubricant flows downwardly along the inner wall of the shell 121, further downward flow of the lubricant is prevented by the baffle 142. The centrifugal force caused by rotation of the hub then causes the liquid lubricant, specifically soapy water, to flow outwardly through the openings 143 and 144 into and among the bristles 134 and 136. In this manner, the liquid lubricant is supplied directly to the center brush sections, which sections are normally exposed to the maximum wear.

Supplying large quantities of liquid lubricant directly to the center brush sections is highly desirable for two reasons. First, supplying large quantities of liquid lubricant directly to these center sections results in better wetting of the contacted surfaces of the vehicle, such as the ridge portion 137 and the bumpers 138. This is particularly important since these outwardly projecting portions of the vehicle often have rapidly changing contours, and thus this greatly increased wetting of these surfaces results in improved washing and cleaning of the vehicle surfaces. Second, the large quantity of lubricant as supplied to these center brush sections also greatly reduces the friction between the vehicle and bristles, and accordingly greatly minimizes the chance of the bristles becoming hung-up on the vehicle due to the unusual contours thereof. This thus greatly minimizes potential damage to either the brush or the vehicle.

Figure 9:
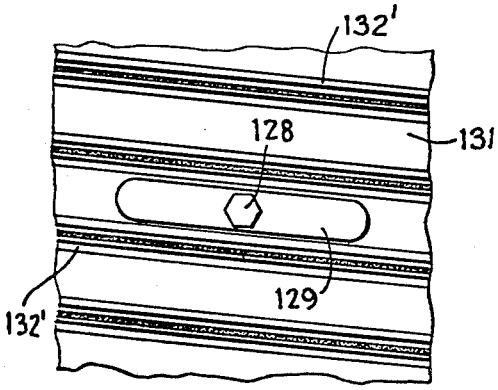
FIG. 9 is a fragmentary view similar to FIG. 8 and illustrating therein a further variation.
Figure 8:
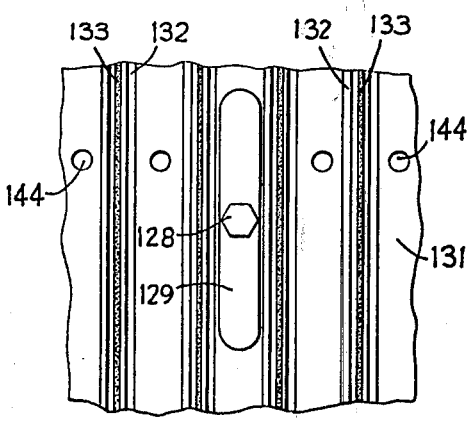
FIG. 8 is an enlarged fragmentary view taken subtantially along the line VIII—VIII in FIG. 6.

FIG. 9 illustrates therein a modification of the brush construction of FIGS. 6–8. More particularly, the brush construction illustrated in FIG. 9 is identical to that of FIG. 6–8 except that the channels 132' which mount the brush bristles extend circumferentially of the support members 31, rather than axially thereof as in FIG. 8. Further, as noted above relative to FIGS. 4 and 5, the channel members 132' can extend circumferentially within a plane substantially perpendicular to the rotational axis of the drum, or alternately the members 132' can be inclined relative to this plane so as to extend spirally around the drum. The structure of the brush sections of FIG. 9 are in all other respects identical to the brush sections described above.

Figure 11:
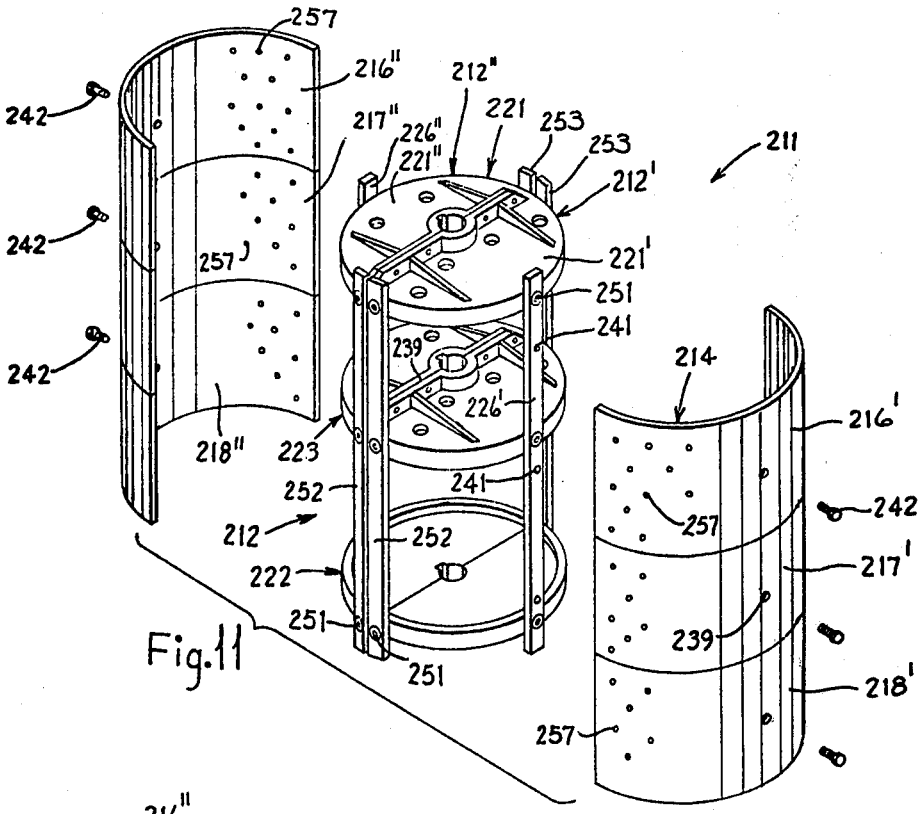
FIG. 11 is an exploded, perspective view similar to FIG. 1 and illustrating a modified brush construction.
Figure 12:
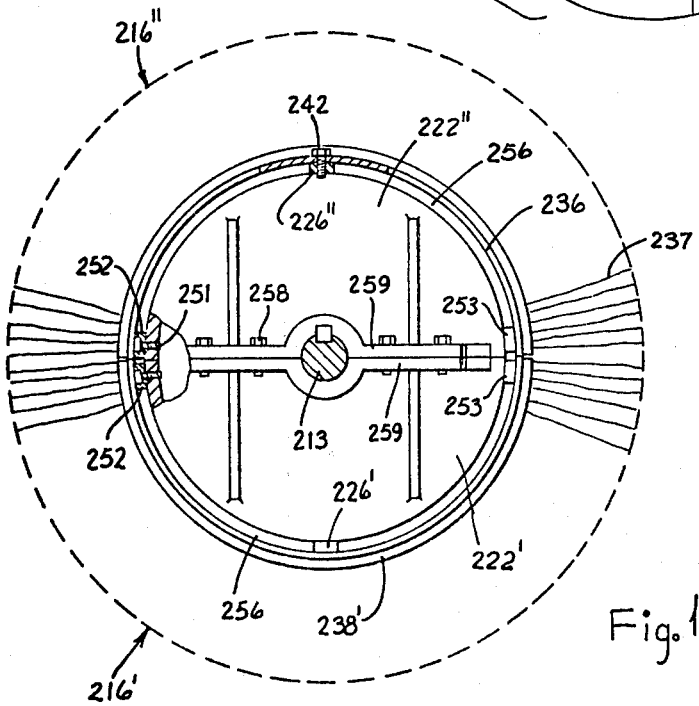
FIG. 12 is a cross-sectional view of the brush construction illustrated in FIG. 11.

Referring now to FIGS. 11 and 12, there is illustrated therein a modified brush construction which is similar to the brush construction illustrated in FIGS. 1–5. Accordingly, the parts of the brush construction in FIGS. 11 and 12 have been identified by the same reference numerals utilized to designate the corresponding parts of the brush construction illustrated in FIGS. 1–5 but with the reference numeral "200" added thereto.

The brush construction 211 illustrated in FIGS. 11 and 12 includes a hub assembly 212 which is nonrotatably secured to a shaft 213 and has opposed pairs of identical brush sections 216'–216'', 217'–217'' and 218'–218'' removably mounted thereon.

The hub assembly 212 is of a construction similar to the construction illustrated in FIG. 1 and includes a plurality of collars 221, 222 and 223 nonrotatably connected to the shaft 213, which collars are each constructed from a pair of separable, substantially semicylindrical, platelike segments, such as the segments 221' and 221''. The pairs of opposed segments are fixedly connected together in surrounding and nonrotatable relationship relative to the shaft 213, as by volts 258 which extend between and fixedly interconnect the flanges 259 which are integral with the collar segments.

The aligned segments associated with the collars 221, 222 and 223 are fixedly connected, as by bolts or screws 251, to elongated connecting bars 226' and 226''. The connecting bars 226' and 226'', as illustrated in FIGS. 11 and 12, are disposed substantially at the midpoint of the external arcuate peripheries of the segments and extend substantially parallel to the rotational axis of the shaft 213.

The aligned segments of the collars 221, 222 and 223 are similarly fixed together by further elongated connecting bars 252 and 253 which extend axially of the hub assembly and are positioned adjacent the opposite ends of the arcuate periphery of the segments. The bars 252 and 253, which are fixed to their respective segments by bolts 251, are positioned closely adjacent one another when the segments are disposed diametrically and directly opposite one another when the hub assembly is assembled.

Considering now the brush sections, and specifically the individual brush sections 216' and 216'' as illustrated in FIGS. 11 and 12, the brush sections each include an arcuate support plate 236 which has the inside surface thereof generated about a radius which is substantially equal to the radial distance from the axis of the shaft 13 to the outer surface of the bars 226, 252 and 253. The support plate 263 extends through an angle of approximately 180° so as to be substantially semicylindrical, and preferably has a plurality of conventional bristles 237 mounted thereon and projecting radially outwardly therefrom. The bristles 237 can be fixed within elongated channel-shaped members 238 which are fixedly secured to the outer surface of the support plate 236 in the manner illustrated in FIGS. 4 and 5.

The individual brush sections, such as the sections 216' and 216'' illustrated in FIG. 12, are mounted on the hub assembly 212 by means of a single screw or bolt 242 which extends through a single centrally located opening 239 formed in the plate 236, with the bolt or screw 242 similarly extending into or through a further opening 241 formed in the respective bar 226' or 226''. The support plate 236 associated with each brush section, when mounted on the hub assembly 212, thus engages the respective support bar 226' or 226'' adjacent the center thereof and also engages one of the bars 252 adjacent one arcuate edge thereof and one of the bars 253 adjacent the other arcuate edge thereof. The plate 236 is thus supported substantially by the three bars, as illustrated in FIG. 12, thereby resulting in an elongated arcuate gap or space 256 between the external periphery of the collar segments and the internal periphery of the plate 236. The gap 256, which comprises an annular ringlike space between the hub assembly and the surrounding brush sections when the overall brush assembly is assembled, thus defines an annular clearance space along the inner periphery of the plates 236 to permit the free flow of lubricant, such as soapy water, through the interior of the brush core.

As illustrated in FIG. 11, the individual plates 236 are each provided with a plurality of openings 257 extending therethrough, which openings provide communication with the exterior surface of the plates between the bristle support channels adjacent the radially inner ends of the bristles. Thus, when the brush construction 211 is in an assembled and operational condition, a suitable lubricant, such as soapy water or the like, can be sprayed into the interior of the brush core through the gap 256, such as by a nozzle 141 illustrated in FIG. 7. The lubricant will then flow along the internal surface of the plates 236 and flow outwardly, as due to centrifugal force, through the openings 257 so as to lubricate the bristles 237 throughout substantially the complete length thereof.

With respect to the brush construction illustrated in FIGS. 11 and 12, the plates 236 are preferably initially provided with an inner curvature which is defined by a radius which is slightly smaller than the external radius defined by the mounting bars 226, 252 and 253. Thus, when the support plate 236 is in an unstressed or relaxed condition, the free ends of the support plate 236 are thus spaced apart by a diametrical distance which is slightly smaller than the diametrical spacing between the opposed bars 252 and 253. Accordingly, when the brush section is mounted on the hub assembly, the support plate 236 must be slightly elastically deformed, as by elastically deflecting the free ends of the support plate 236 outwardly, so that the plate 236 will then slip over the bars 252 and 253. The free edges of the support plate 236 will thus be pretensioned into engagement with the bars 252 and 253, whereby the complete brush section can thus be securely mounted on the hub assembly by means of the bolt or screw 242 which coacts with the center mounting bar 226' or 226''. The plates 236 are thus preferably constructed in a manner similar to the construction illustrated in FIG. 10.

While the construction illustrated in FIGS. 11 and 12 utilizes a plurality of axially aligned brush sections 216', 217' and 218', it will be appreciated that the sections 216', 217' and 218' could be formed as a single substantially semicylindrical section, and the segments 216'', 217'' and 218'' could be similarly so formed.

Figure 13:
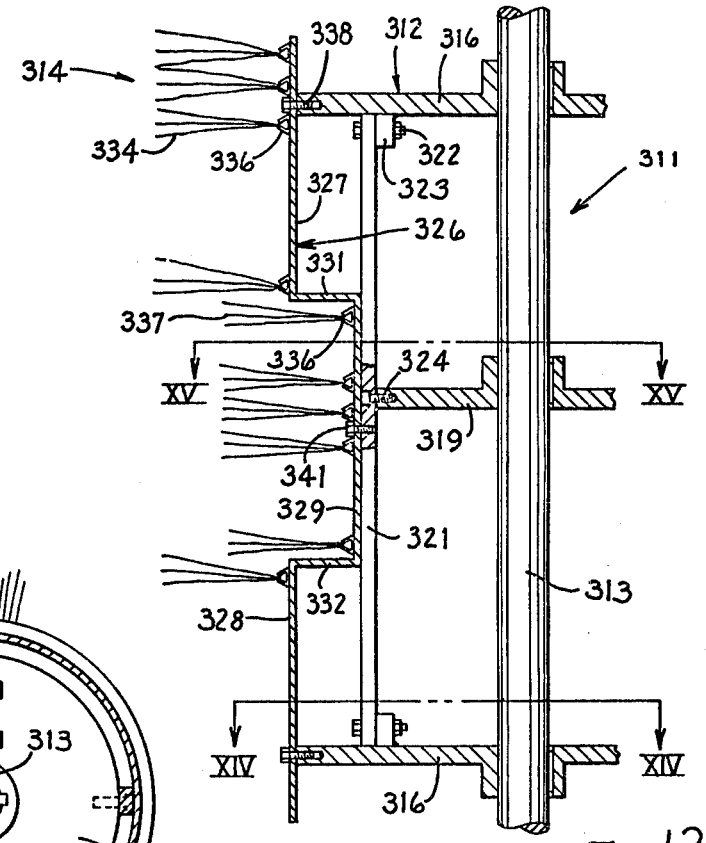
FIG. 13 is a fragmentary, longitudinal cross-sectional view of still a further modified brush construction.
Figure 15:
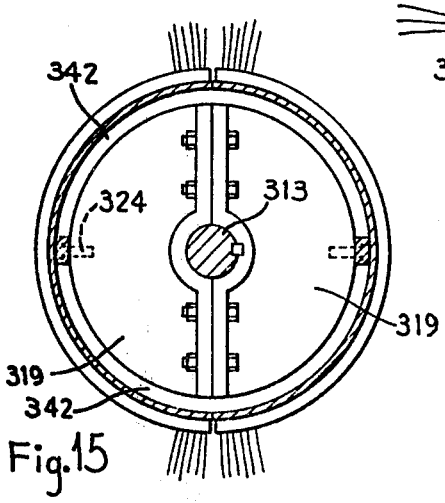
FIG. 15 is a sectional view taken substantially along the line of XV—XV in FIG. 13.
Figure 14:
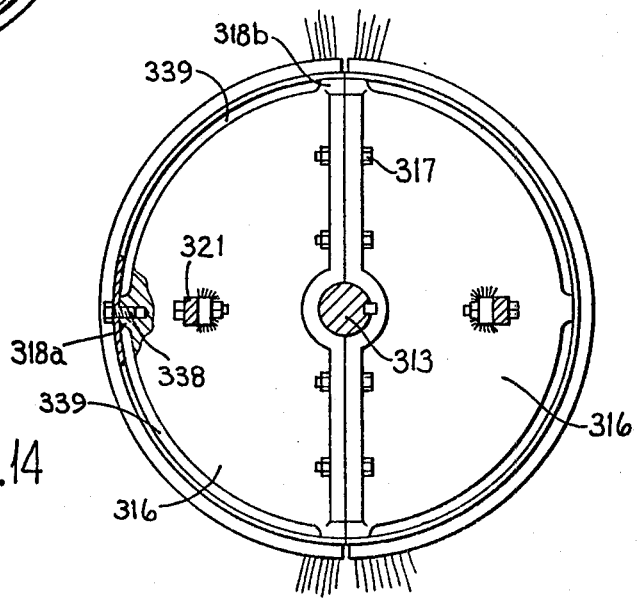
FIG. 14 is a sectional view taken substantially along the line XIV—XIV in FIG. 13.

FIGS. 13–15 illustrate therein still a further modification of the present invention wherein there is illustrated a brush construction 311 which is designed to conform to portions of a vehicle which project outwardly a substantial distance, such as the new shock-absorbing front bumpers. The present shock-absorbing bumpers project forwardly of the vehicle by a substantial distance. Accordingly, the brush which moves over the front of the vehicle often tends to hang up on the front bumper, causing damage to either the bumper or the brush. Alternately, if the brush is spaced sufficiently from the vehicle to prevent damage to the bumper, then the brush bristles do not adequately contact the remaining front surfaces of the vehicle. The brush illustrated in FIGS. 13–15 is designed to overcome this problem, by providing the brush with axially spaced portions of different diameters so as to conform with the unusual contours of the vehicle.

The brush construction 311 includes a hub assembly 312 which is adpated to be nonrotatably secured to a conventional drive shaft 313. The hub assembly 312 in turn has a pair of substantially semicylindrical, removable brush sections 314 mounted thereon.

Considering the hub assembly 312, same includes upper and lower collars each of which includes a pair of substantially semicylindrical collar segments 316, which collar segments are fixedly secured in nonrotatable relationship to the shaft by bolts 317. Each collar segment 316 is provided with a projection **318*a* projecting outwardly from the outer periphery thereof substantially at the midpoint, and is also provided with a further pair of projections 318*b*** projecting outwardly from the outer periphery thereof adjacent the opposite ends of the outer arcuate periphery. The purpose of these projections will be explained hereinafter.

The hub assembly 312 also includes a further center collar formed from a pair of opposed platelike, semicylindrical collar segments 319, which collar segments are suitably bolted together in fixed nonrotatable clamping engagement with the shaft 313. The collar segments 319 have a substantially smaller diameter than the end collar segments 316 and are fixedly connected adjacent the midpoint of the outer periphery thereof to an axially elongated mounting bar 321. The mounting bar 321 extends axially between the end collar segments 316 and has the opposite ends thereof suitably fixed to the collars by means of bolts or screws 322, which screws or bolts connect to suitable flanges 323 which are fixed to the respective end collar segments 316. The mounting bar 321 is in turn fixed to the center collar segments 319 by means of suitable screws 324.

Considering now the brush section 314, same includes a substantially semicylindrical support plate or shell 326 which includes a pair of spaced end shell portions 327 and 328 which are of substantially greater diameter than the center shell portion 329. The end shell portions 327 and 328, which in the illustrated embodiment are of substantially the same diameter, are fixedly and integrally connected to the center shell portion 329 by radial walls 331 and 332 which extend therebetween.

The end shell portions 327 and 328 are both provided with a plurality of brush bristles 334 projecting radially outwardly therefrom, which bristles can be mounted in the abovedescribed manner within channel shaped mounting members 336, which channel members 336 are fixedly secured to the outer surface of the shell portions 327 and 328. The channel members 336, as illustrated in FIGS. 13–15, extend circumferentially or helically of the shell, but these members could likewise extend axially of the shell if desired.

The center shell section 329 is also provided with similar brush bristles 337 mounted thereon and projecting radially therefrom, which bristles can also be mounted within similar channels 336. The bristles 337 can, if desired, be identical to the bristles 334 or, alternately, the bristles 337 can be shorter, longer, or of different density from the bristles 334.

The brush section 314 is removably connected to the hub assembly 312 by a pair of bolts 338 which are associated with the opposite ends of the shell and threadably engage the end collar segments 316 through the center projections 318*a*. The opposed free edges of the shell 326 adjacent the opposite axial ends thereof are maintained in engagement with the projections 318*b* formed on the end collar segments 316 as illustrated in FIG. 14. This thus results in an elongated gap 339 being formed between the collar segment 316 and the shell portions 327 and 328 so as to permit lubricant to be supplied to the internal annular surface of the shell. The center shell section 329 is also suitably connected, as by a bolt or screw 341, to the mounting bar 321. The presence of the mounting bar 321 also results in the formation of an annular gap 342 between the shell section 329 and the center collar segment 319 so as to permit free passage of lubricant therethrough. The shell sections 327, 328 and 329 are provided with a plurality of apertures (not shown) extending radially therethrough. Thus, lubricants can be supplied into the interior of the shell sections, as through the gaps 339 and 342, which lubricant then flows outwardly through the apertures in the shell sections so as to be supplied to and between the radially inner ends of the bristles to provide for lubrication thereof.

The brush construction illustrated in FIGS. 13–15, due to the substantial diametrical difference between the axially adjacent sections, will thus readily conform to the widely varying profile of the vehicle, such as the front bumper, so as to permit efficient and proper washing of the vehicle while at the same time preventing damage to the vehicle and also preventing hang-up of the brush or undue brush wear.

The utilization of the brush constructions of the present invention on an overall vehicle washing apparatus are substantially conventional and self-explanatory in view of the detailed description set forth above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An improved rotary brush construction having a rotatable hub unit and a plurality of arcuate bristle-carrying brush sections adapted to be detachably mounted on said hub unit circumferentially thereof, and connecting means for removably mounting said brush sections on said hub unit, comprising the improvement wherein each of said brush sections includes an arcuate substantially semi-cylindrical shell having a plurality of bristles mounted thereon and projecting radially outwardly thereof, said shell when in a relaxed and unstressed condition having an internal diameter slightly less than the maximum external diameter of said hub unit, whereby mounting of said brush section on said hub unit causes said shell to be elastically deformed to enable the inner periphery of said shell to conform to the maximum external diameter of said hub unit, said connecting means fixedly maintaining said shell on said hub unit so as to maintain said shell in an elastically deformed condition.

2. A brush construction according to claim 5, wherein said connecting means comprises a threaded fastening element extending between each said brush section and said cylindrical hub unit for fixedly but detachably connecting same together, said threaded fastening element being positioned substantially at the midpoint of said shell and comprising the sole structure for maintaining each brush section on said hub unit.

3. A rotary brush construction, particularly for washing vehicles, comprising:

a rotatable hub unit;

a first substantially cylindrical brush segment nonrotatably mounted on said hub unit and surrounding same, said first brush segment including a plurality of outwardly projecting bristles fixedly mounted thereon and defining a first bristle density;

a second substantially cylindrical brush segment mounted on and surrounding said hub unit and being nonrotatably connected thereto, said second brush segment being closely adjacent and axially aligned with said first brush segment, said second brush segment also having a plurality of bristles mounted thereon and projecting outwardly therefrom, the bristles associated with said second brush segment defining a second bristle density which is substantially less than the first bristle density associated with the first brush segment; and said second brush segment including a plurality of substantially uniform spaced first bristles mounted thereon, said first bristles having a first length, said second brush segment also having a plurality of second bristles substantially uniformly mounted thereon and intermixed with said first bristles, said second bristles having a length substantially greater than the length of said first bristles.

4. A brush construction according to claim 3, wherein said first cylindrical brush segment has a plurality of third bristles substantially uniformly mounted thereon, said third bristles having a length substantially the same as the length of said second bristles, the density of said third bristles being substantially greater than the density of said second bristles.

5. A brush construction according to claim 4, wherein said brush construction includes a third substantially cylindrical brush segment disposed in surrounding relationship to and fixedly mounted on said hub unit, said second brush segment being axially aligned with and disposed axially between said first and third cylindrical brush segments, each of said brush segments including a pair of substantially semi-cylindrical brush sections, and means for individually but removably mounting each of said brush sections on said hub unit.

6. A brush construction according to claim 3, further including means for supplying liquid lubricant in the direct vicinity of the bristles associated with said second cylindrical brush segment.

7. A brush construction according to claim 6, wherein said lubricant supplying means includes means associated with said hub unit for causing said lubricant to flow radially outwardly of said hub unit into direct contact with the bristles associated with said second cylindrical brush segment.

8. A rotatable brush construction, particularly for vehicles, comprising:

rotatable axially elongated hub means including a hollow substantially cylindrical tubular shell having a substantially continuous wall structure;

a plurality of substantially cylindrical bristle-carrying brush segments surrounding and fixedly mounted on said tubular shell, said plurality of brush segments being disposed adjacent and axially aligned with one another to result in the formation of a substantially continuous cylindrical bristle arrangement; and lubricating means associated with the hollow interior of said tubular shell for causing substantial quantities of liquid lubricant to flow radially outwardly of said hub unit into direct contact with the bristles associated with one of said cylindrical brush segments;

said lubricating means including means for depositing lubricant on the internal wall surface of said shell adjacent the upper end thereof, said lubricating means further including an annular baffle structure fixed to said wall structure and projecting radially inwardly thereof in substantially radial alignment with said one brush segment, and a plurality of openings extending radially through the wall of said shell directly above said baffle structure, whereby the liquid lubricant as deposited on the upper internal wall surface of said shell flows downwardly therealong due to gravity until reaching the baffle structure whereupon centrifugal force causes the liquid lubricant to flow radially outwardly through said openings into contact with the bristles associated with said one brush segment.

9. A brush construction according to claim 8, wherein said plurality of cylindrical brush segments includes first and second axially spaced brush segments disposed adjacent the opposite axial ends of said shell, said plurality of cylindrical brush segments including a third cylindrical brush segment disposed axially between said first and second brush segments, each of said segments including a pair of substantially semi-cylindrical brush sections positioned directly opposite one another and removably fixedly connected to said shell, said lubricating means causing increased quantities of said lubricants to be supplied radially outwardly of said shell directly to the bristles of only one of the above-mentioned brush segments.

10. A brush construction according to claim 9, wherein the density of the bristles adjacent the radially outer ends thereof as mounted on one of said brush segments is substantially less than the density of the bristles adjacent the radially outer ends thereof as mounted on the remaining brush segments.

11. A brush construction according to claim 9, wherein said baffle structure is disposed radially inwardly of the third brush segment and said openings project radially outwardly through said shell for communicating with the bristles of said third brush segment, said third brush segment including a plurality of first bristles substantially uniformly mounted thereon and projecting outwardly therefrom and a plurality of second bristles substantially uniformly mounted thereon and dispersed within said first bristles, the second bristles having a length substantially greater than the length of said first bristles, said first and second brush segments both having a plurality of third bristles substantially uniformly mounted thereon and projecting outwardly therefrom, said third bristles having a length similar to the length of said second bristles, and the density of said second bristles being substantially less than the density of said third bristles.

12. A rotatable brush construction, particularly for washing of vehicles, comprising:

rotatable axially elongated hub means rotatable about an upright axis and including a hollow substantially cylindrical tubular shell having a substantially continuous wall structure;

brush means surrounding and fixedly mounted on said tubular shell and forming a substantially continuous cylindrical bristle arrangement, said brush means including a plurality of bristles which project outwardly from the shell with said bristles extending both axially and circumferentially around said shell to form said substantially continuous cylindrical bristle arrangement;

lubricating means associated with the hollow interior of said tubular shell for causing substantial quantities of liquid lubricant to flow radially outwardly from the interior of said tubular shell into direct contact with the bristles mounted thereon, said lubricating means including means for depositing lubricant on the internal wall surface of said shell adjacent the upper end thereof; and said lubricating means further including an annular baffle structure fixed to said cylindrical shell and projecting radially inwardly from the internal wall structure thereof, said baffle structure being located intermediate the upper and lower ends of said shell, and a plurality of openings spaced circumferentially around the shell and extending radially through the wall thereof directly above said baffle structure, whereby the liquid lubricant as deposited on the upper internal wall surface of said shell flows downwardly therealong due to gravity until reaching the baffle structure whereupon centrifugal force causes the liquid lubricant to flow radially outwardly through said openings into contact with the bristles which are mounted on the shell in the vicinity of said openings.

* * * * *